US012066208B2

(12) United States Patent
Goldfarbmuren et al.

(10) Patent No.: US 12,066,208 B2
(45) Date of Patent: Aug. 20, 2024

(54) TEMPERATURE AND HUMIDITY CONTROL METHODS, SYSTEMS, AND DEVICES

(71) Applicant: Rebound Technologies, Inc., Commerce City, CO (US)

(72) Inventors: Russell Goldfarbmuren, Denver, CO (US); Luke Erickson, Denver, CO (US)

(73) Assignee: Rebound Technologies, Inc., Commerce City, CO (US)

( * ) Notice: Subject to any disclaimer, the term of this patent is extended or adjusted under 35 U.S.C. 154(b) by 0 days.

(21) Appl. No.: 17/746,006

(22) Filed: May 17, 2022

(65) Prior Publication Data

US 2022/0364761 A1 Nov. 17, 2022

Related U.S. Application Data

(60) Provisional application No. 63/189,259, filed on May 17, 2021.

(51) Int. Cl.

| | |
|---|---|
| ***F24F 12/00*** | (2006.01) |
| ***F24F 8/00*** | (2021.01) |
| ***F25D 13/00*** | (2006.01) |
| ***F25D 17/06*** | (2006.01) |

(52) U.S. Cl.
CPC ..... *F24F 12/002* (2013.01); *F24F 8/00* (2021.01); *F25D 13/00* (2013.01); *F25D 17/06* (2013.01)

(58) Field of Classification Search
CPC ... F25D 17/06; F24F 13/00; F24F 8/00; F24F 12/002; F24F 12/001; F24F 3/1423
See application file for complete search history.

(56) References Cited

U.S. PATENT DOCUMENTS 2,485,630 A * 10/1949 Munters ..... F25D 23/068 62/234
2010/0084483 A1* 4/2010 Pieper ..... F24F 3/1423 236/44 A

FOREIGN PATENT DOCUMENTS

EP 0167096 A2 * 1/1986
IN 6940/ * 12/2015
WO WO2016/081933 5/2016

OTHER PUBLICATIONS

EP0167096A2 Translation (Year: 1986).*

* cited by examiner

*Primary Examiner* — Schyler S Sanks
(74) *Attorney, Agent, or Firm* — Wilson Patent Law, LLC

(57) ABSTRACT

Methods, systems, and devices provided in accordance with various embodiments are generally related to the field of thermal management systems for buildings (or volumes in general), such as cold storage, food processing, or other buildings that have areas that are kept below freezing. Embodiments generally pertain to the management of temperature and humidity within these spaces. Some embodiments include system for the management of moisture and temperature inside cold spaces. Some embodiments include a heat and mass transfer exchanger, such as a direct constant gas liquid heat and mass transfer exchanger. Examples of such heat and mass transfer exchangers generally include wet scrubbers. Embodiments also generally include a series of ducts, pipes, heat exchangers, dampers, and/or valves that may allow the system to provide useful temperature and relative humidity levels to one or more spaces or volumes.

18 Claims, 14 Drawing Sheets

TEMPERATURE AND HUMIDITY CONTROL METHODS, SYSTEMS, AND DEVICES

CROSS-REFERENCES TO RELATED APPLICATIONS

This application is a non-provisional patent application claiming priority benefit of U.S. provisional patent application Ser. No. 63/189,259, filed on May 17, 2021 and entitled "TEMPERATURE AND HUMIDITY CONTROL METHODS, SYSTEMS, AND DEVICES," the entire disclosure of which is herein incorporated by reference for all purposes.

BACKGROUND

Temperature and/or humidity control for various thermal management systems can pose a variety of problems. For example, excessive humidity may lead to condensation or frosting issues for some systems while they may also cause safety issues throughout workspaces in some cases.

There may be a need for new tools and techniques to address humidity issues and/or provide for temperature and humidity control in general for thermal management systems.

SUMMARY

Methods, systems, and devices provided in accordance with various embodiments are generally related to the field of thermal management systems for buildings (or volumes in general), such as cold storage, food processing, or other buildings that have areas that are kept around or below freezing. Embodiments generally pertain to the management of temperature and humidity within these spaces. Some embodiments include a system for the management of moisture and temperature inside cold spaces. Some embodiments include a heat and mass transfer exchanger, such as a direct constant gas liquid heat and mass transfer exchanger. Examples of such heat and mass transfer exchangers generally include wet scrubbers. Embodiments also generally include a series of ducts, dampers, pipes, heat exchangers, and/or valves that may allow the system to provide useful temperature and relative humidity levels to one or more spaces or volumes.

Some embodiments include a method that includes: removing air from a first volume; passing the air from the first volume through a heat and mass transfer exchanger to decrease a temperature and a moisture content of the air from the first volume; and sending at least a portion of the air from the first volume to a second volume after passing the air from the first volume through the heat and mass transfer exchanger; a temperature of the first volume may be greater than a temperature of the second volume.

Some embodiments of the method include flowing air from the second volume to the first volume. In some embodiments, passing the air from the first volume through the heat and mass transfer exchanger to decrease the temperature and the moisture content of the air from the first volume includes passing the air from the first volume through a wet scrubber. In some embodiments, passing the air from the first volume through the wet scrubber includes flowing a brine counter to a flow of the air from the first volume; a temperature of the brine may be lower than a temperature of the air from the first volume. Some embodiments include passing at least a portion of the brine from the web scrubber and at least the portion of the air from the first volume through a recuperator to decrease the temperature of the brine and to increase a temperature of at least the portion of the air from the first volume.

Some embodiments of the method include distributing at least the portion of the air from the first volume sent to the second volume utilizing a distribution plenum positioned within the second volume. Some embodiments of the method include introducing ambient air into the first volume.

Some embodiments of the method include passing at least the portion of the air from the first volume through a recuperator. In some embodiments, passing at least the portion of the air from the first volume through the recuperator occurs after the air from the first volume passes through the heat and mass transfer exchanger such that the temperature of at least the portion of the air from the first volume increases through passing through the recuperator. Some embodiments include passing the air from the first volume through the recuperator before the air from the first volume passes through the heat and mass transfer exchanger such that the temperature of the air from the first volume decreases through passing through the recuperator. In some embodiments, passing at least the portion of the air from the first volume through the recuperator increases the temperature of at least the portion of the air from the first volume after the air from the first volume passes through the heat and mass transfer exchanger. Some embodiments include combining the air from the first volume with air from the second volume prior to passing the air from the first volume through the heat and mass transfer exchanger.

Some embodiments of the method include combining the air from the first volume with air from the second volume prior to passing the air from the first volume through the heat and mass transfer exchanger. Some embodiments include combining ambient air with at least the air from the first volume or the air from the second volume prior to passing at least the air from the first volume, the air from the second volume, or the ambient air through the heat and mass transfer exchanger.

In some embodiments of the method, flowing the air from the second volume to the first volume includes flowing the air from the second volume to the first volume through a blast freezer positioned between the first volume and the second volume. Some embodiments include moving a product through the blast freezer counter to the air from the second volume flowing to the first volume through the blast freezer.

Some embodiments of the method include combining the air from the first volume with air from the second volume prior to passing the air from the first volume through the heat and mass transfer exchanger. Some embodiments include positioning a blast freezer between the first volume and the second volume.

Some embodiments of the method include: removing air from the second volume; passing the air from the second volume through the heat and mass transfer exchanger to decrease a temperature and a moisture content of the air from the second volume; and sending at least a portion of the air from the second volume to the second volume after passing the air from the first volume through the heat and mass transfer exchanger. Some embodiments include at least passing the air from the second volume through a recuperator before passing the air from the second volume through the heat and mass transfer exchanger or passing at least the portion of the air from the second volume through the recuperator after the air from the second volume passes through the heat and mass transfer exchanger.

Some embodiments include a system that includes: a first volume; a heat and mass transfer exchanger configured to receive air from the first volume and to decrease a temperature and a moisture content of the air from the first volume; and a second volume configured to receive at least a portion of the air from the first volume after passing the air from the first volume through the heat and mass transfer exchanger; a temperature of the first volume may be greater than a temperature of the second volume.

Some embodiments of the system include an interconnection configured to allow air to flow from the second volume to the first volume. Some embodiments of the system include an interconnection configured to introduce ambient air into the first volume.

In some embodiments of the system, the heat and mass transfer exchanger includes a wet scrubber. In some embodiments, the wet scrubber flows a brine counter to a flow of the air from the first volume; a temperature of the brine may be lower than a temperature of the air from the first volume. Some embodiments include a recuperator coupled with the wet scrubber such that at least a portion of the brine from the wet scrubber and at least the portion of the air from the first volume pass through the recuperator to decrease the temperature of the brine and to increase a temperature of at least the portion of the air from the first volume.

Some embodiments of the system include a distribution plenum that distributes at least the portion of the air from the first volume within the second volume. Some embodiments include a suction plenum that removes the air from the first volume.

Some embodiments of the system include a recuperator configured to receive at least the portion of the air from the first volume. In some embodiments, the recuperator is configured to receive at least the portion of the air from the first volume such that the temperature of at least the portion of the air from the first volume increases through passing through the recuperator. In some embodiments, the recuperator is configured to receive the air from the first volume before the air from the first volume passes through the heat and mass transfer exchanger such that the temperature of the air from the first volume decreases through passing through the recuperator. In some embodiments, the recuperator configured to receive at least the portion of the air from the first volume increases the temperature of at least the portion of the air from the first volume after the air from the first volume passes through the heat and mass transfer exchanger. Some embodiments include a mixer configured to combine the air from the first volume with air from the second volume prior to passing the air from the first volume through the heat and mass transfer exchanger.

Some embodiments of the system include a mixer configured to combine the air from the first volume with air from the second volume prior to passing the air from the first volume through the heat and mass transfer exchanger. In some embodiments, the mixer is configured to combine ambient air with at least the air from the first volume or the air from the second volume prior to passing at least the air from the first volume, the air from the second volume, or the ambient air through the heat and mass transfer exchanger.

In some embodiments, the interconnection configured to allow air to flow from the second volume to the first volume includes a blast freezer positioned between the first volume and the second volume. In some embodiments, the blast freezer is configured such that a product moves through the blast freezer counter to the air from the second volume flowing to the first volume.

In some embodiments of the system that may include the recuperator configured to receive at least the portion of the air from the first volume may also include a mixer configured to combine the air from the first volume with air from the second volume prior to passing the air from the first volume through the heat and mass transfer exchanger. Some embodiments include a blast freezer positioned between the first volume and the second volume such that air from the second volume flows through the blast freezer to the first volume.

In some embodiments of the system, the mixer is configured to prevent an airflow from the first volume to the heat and mass transfer exchanger and to direct an airflow from the second volume to the heat and mass transfer exchanger. Some embodiments include a recuperator configured to receive at least a portion of the airflow from the second volume after the airflow from the second volume passes through the heat and mass transfer exchanger.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
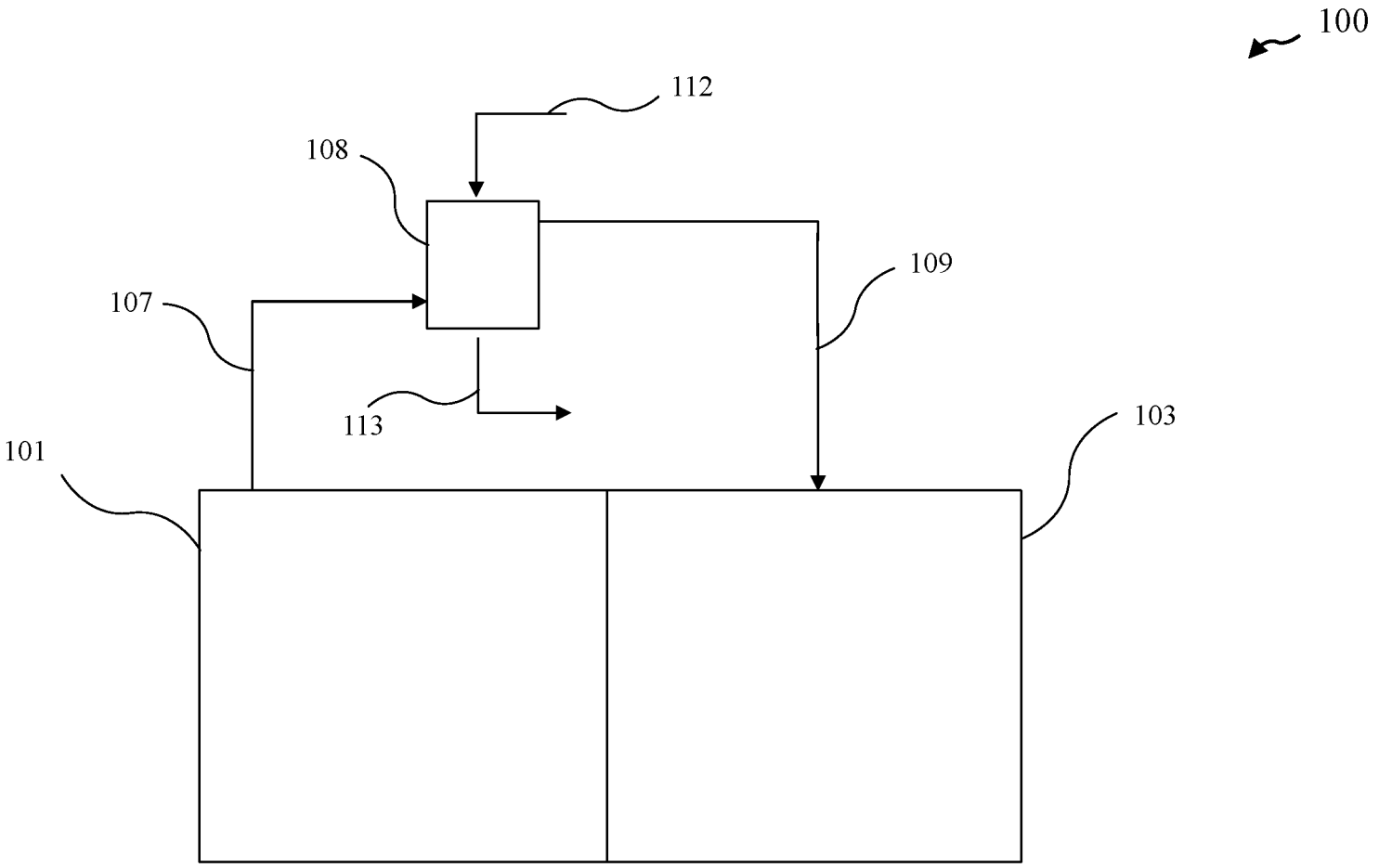
FIG. 1 shows a system in accordance with various embodiments.

This description provides embodiments, and is not intended to limit the scope, applicability, or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted, or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Methods, systems, and devices provided in accordance with various embodiments are generally related to the field of thermal management systems for buildings (or volumes in general), such as cold storage, food processing, or other buildings that have areas that are kept below ambient. Embodiments generally pertain to the management of temperature and humidity within these spaces. Some embodiments include a system for the management of moisture and temperature inside cold spaces. Some embodiments include a heat and mass transfer exchanger, such as a direct constant gas liquid heat and mass transfer exchanger. Examples of such heat and mass transfer exchangers generally include wet scrubbers. Embodiments also generally include a series of ducts, pipes, heat exchangers, dampers, and/or valves that may allow the system to provide useful temperature and relative humidity levels to one or more spaces or volumes.

In general, the majority of the thermal work may be done by the heat and mass transfer exchanger(s), which may include wet scrubber(s). Heat and mass transfer exchangers such as wet scrubbers generally allow a liquid and a gas to mix in a controlled way to produce predictable heat and mass transfer. The mixing within the various systems and/or devices provided may be achieved in many different ways, including, but not limited to, vertical flow over a packed bed, horizontal flow over a packed bed, spray into the flow, spray against the flow, flow through tray(s), and/or entraining flow through a venturi or ejector. Some embodiments are constructed in such a way to work with any of these heat and mass transfer approaches.

In some embodiments, the heat and mass transfer exchanger(s) may be surrounded by a system of ducting, valves, and/or heat exchangers that may enable the heat and mass transfer exchanger(s) to operate more effectively and/or to deliver more useful temperatures and/or humidity values. On a high level, these components may allow the heat and mass transfer exchanger to adjust the amount of moisture that may be removed from the air relative to the amount of cooling that may be done to the air. This ratio is generally known as the Sensible Heat Ratio (SHR) and is of general importance to the thermal management of refrigerated facilities.

Some embodiments generally include the combination of the heat and mass transfer exchanger(s) and components coupled with the heat and mass transfer exchanger(s). In general, the use of the term brine may refer to a hydrophilic liquid. The brine may include a polar liquid. Some examples of brines include liquids that may include a freeze point suppressant including, but not limited to, water, ionic liquids, salt, non-salt soluble solids, organic liquid, inorganic liquid, mixtures of miscible materials, and/or a surfactant-stabilized mixture of immiscible materials.

FIG. 1 shows a general system 100 in accordance with various embodiments. In system 100, a facility with a warmer room 101 (which may be referred to in general as a first volume) and a cooler room 103 (which may be referred to in general as a second volume) are both cooled via the various embodiments. A temperature of first volume 101 may be higher than a temperature of the second volume 103, as reflected in the terms warmer room 101 and cooler room 103. Warmer air 107 may be removed from the first volume 101 and may be sent to a heat and mass transfer exchanger 108, such as a wet scrubber, where cold brine 112 may flow counter to it. The cold brine 112 may have a temperature that is lower than a temperature of the warmer air 107 from the first volume 101. This may produce colder, dry air 109 and warmer brine 113 (i.e., air 109 may be colder and drier than the warmer air 107 such that a temperature and a moisture content of the air 107 may decrease through passing through the heat and mass transfer exchanger 108, and the warmer brine 113 may be warmer than the cold brine 112). In some cases, the colder, drier air 109 may have a temperature comparable to the cold brine 112, while the warmer brine 113 may have a temperature comparable to warmer air 107. The cold air 109 may be sent to the second volume 103, which may be referred to as a colder room in some embodiments; in some embodiments, a portion of the air 109 may be sent to the second volume 103 such that another portion of the air 109 may be sent to one or more other volumes, which may also generally be referred to as cooler volumes. In its most general form, the heat and mass transfer exchanger 108 (such as a wet scrubber) may be of any style and the surrounding equipment may merely include ducting to move the air through the equipment.

Some embodiments may be considered as a device or subsystem with respect to system 100 in accordance with various embodiments. For example, some devices or subsystems in accordance with various embodiments may be considered as the heat and mass transfer exchanger 108 combined with components configured to deliver the cold brine 112 to the heat and mass transfer exchanger 108 along with components configured to deliver the air 107 from a general first volume 101 to the heat and mass transfer exchanger 108 and components configured to deliver the air 109 from the heat and mass transfer exchanger 108 to a general volume 103, where air from the first volume 101 is warmer than air from the second volume 103. Various components may be utilized to achieve this device and/or subsystem such as ducts, dampers, pipes, heat exchangers, and/or valves that may be coupled with the heat and mass transfer exchanger 108.

System 100 may include additional components not necessarily shown in one or more of the figures. For example, the first volume 101 and the second volume 103 may be coupled with additional temperature control components, such as cooling components, that may at least affect the temperatures and/or moisture contents of the respective volumes. System 100 of FIG. 1 may also include other components that may be shown with respect to one or more of the other figures, such as recuperator(s), mixer(s), and/or interconnection(s) (such as doors and/or blast freezers).

Figure 2:
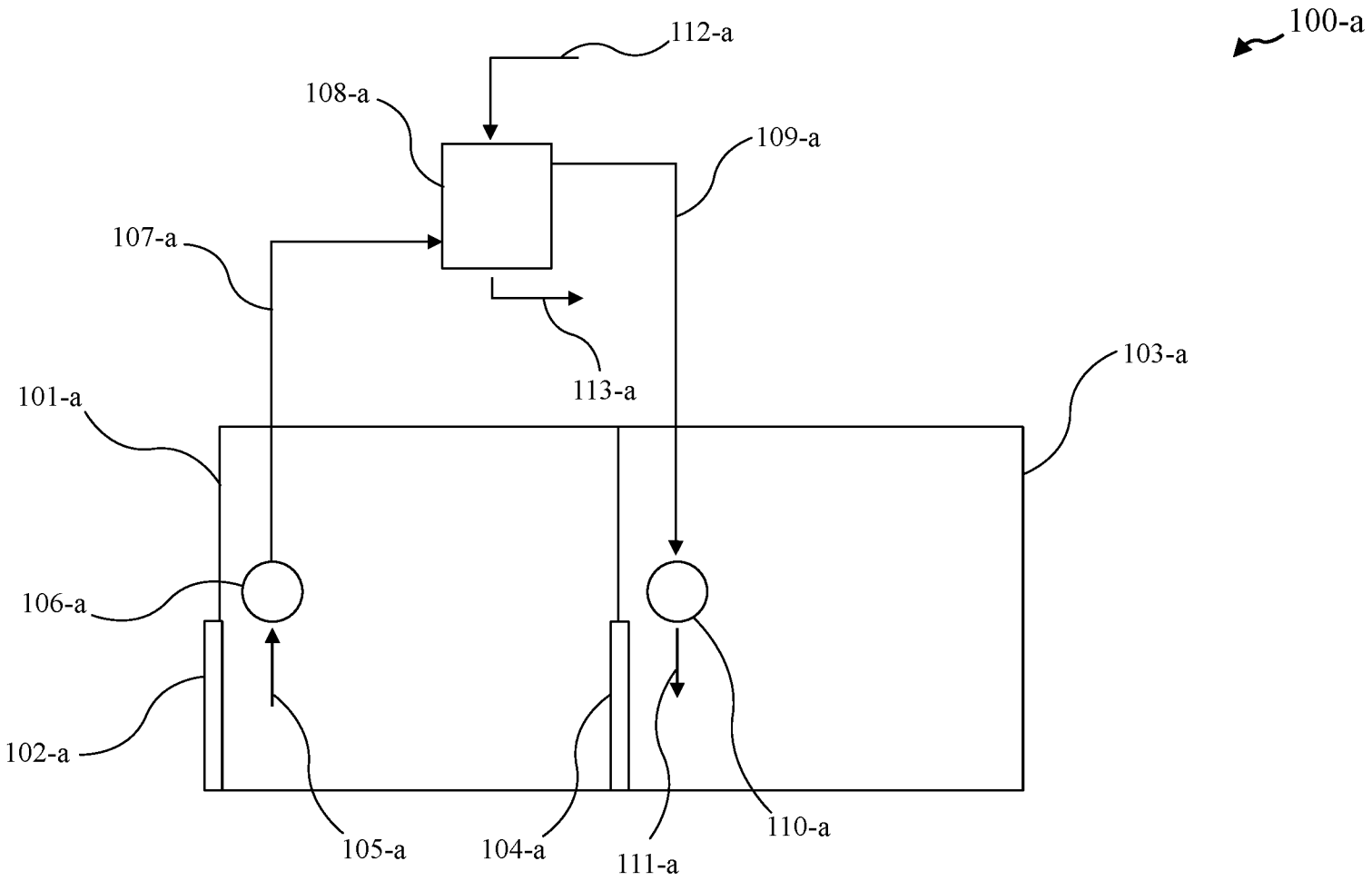
FIG. 2 shows a system in accordance with various embodiments.

FIG. 2 shows a system 100-*a* that may be a specific example of system 100 of FIG. 1. A warmer room 101-*a*, which may be referred to in general as a first volume, may have a door to the outside 102-*a* and a suction plenum 106-*a*, which may be near door 102-*a* to provide suction of room air 105-*a*. Once in the duct, warmer air 107-*a* may be sent to a heat and mass transfer exchanger 108-*a*, such as a wet scrubber, where cold brine 112-*a* may flow counter to it. This may produce colder, dry air 109-*a* and warmer brine 113-*a*. The cold air 109-*a* may be sent to a colder room 103-*a*, which may be referred to generally as a second volume, where it may enter a distribution plenum 110-*a*, which may be positioned near a door 104-*a* between the first volume 101-*a* and the second volume 103-*a*. This may distribute cold, dry air 111-*a* near the door 104-*a*, which may protect the colder temperature in room 103-*a* as the door 104-*a* may be used. Doors 102-*a* and 104-*a* may be referred to as interconnections. For example, door 104-*a* may allow for air to flow from the second volume 103-*a* to the first volume 101-*a* when the door 104-*a* is opened. Door 102-*a* may allow for ambient air from outside the first volume 101-*a* to flow into volume 101-*a* and/or air from volume 101-*a* to flow out of volume 101-*a* to ambient when door 102-*a* may be opened.

Figure 3:
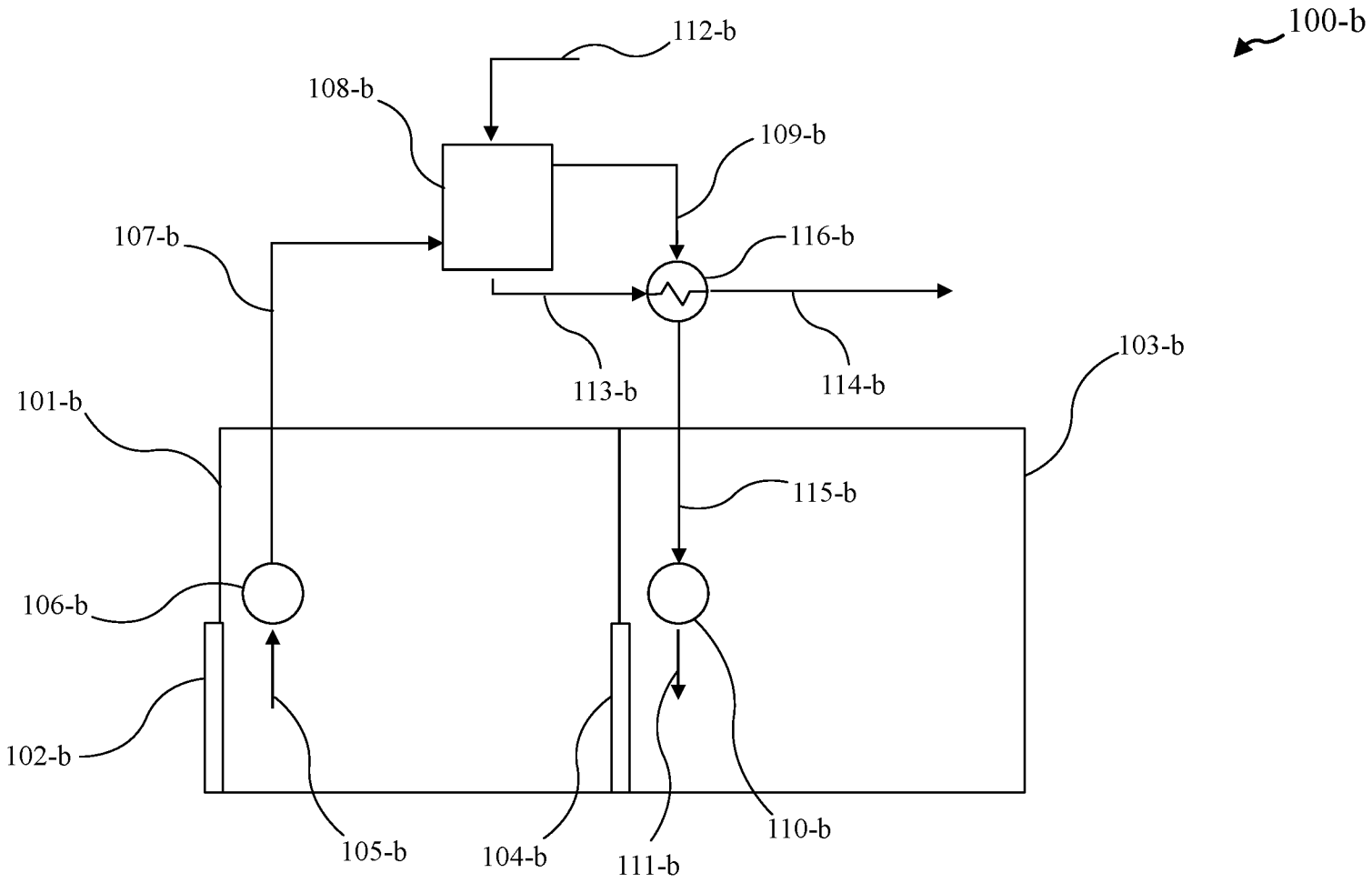
FIG. 3 shows a system in accordance with various embodiments.

FIG. 3 shows a system 100-*b* that may be a specific example of system 100 of FIG. 1 and/or system 100-*a* of FIG. 2. System 100-*b* may utilize a brine-to-air recuperator 116-*b* to return warmer air 115-*b* at a lower relative humidity to a cooler room 103-*b* (or a second volume in general). A warmer room 101-*b* (or a first volume in general) may have a door to an outside 102-*b* and a suction plenum 106-*b* near the door 102-*b*, which may provide suction of room air 105-*b*. Once in the duct, warmer air 107-*b* may be sent to a heat and mass transfer exchanger 108-*b*, such as a wet scrubber, where cold brine 112-*b* may flow counter to it. This may produce colder, dry air 109-*b* and warmer brine 113-*b*. The cold air 109-*b* may be sent to the brine-to-air recuperator 116-*b* where the air may be warmed and the brine may be cooled without any mass transfer; the recuperator 116-*b* may be configured to receive at least a portion of the air 109-*b* from the first volume. This may produce a warmer air 115-*b* (i.e., at least the portion of the air from the first volume may increase through passing through the recuperator 116-*b*) and a colder brine 114-*b*. The air 115-*b* may be sent to the colder room 103-*b* where it may enter a distribution plenum 110-*b*, which may be positioned near a door 104-*b* between the rooms 101-*b* and 303-*b*. This may distribute cold, dry air 111-*b* near the door 104-*b*, which may protect the colder temperature in room 103-*b* as the door 104-*b* may be used.

Figure 4:
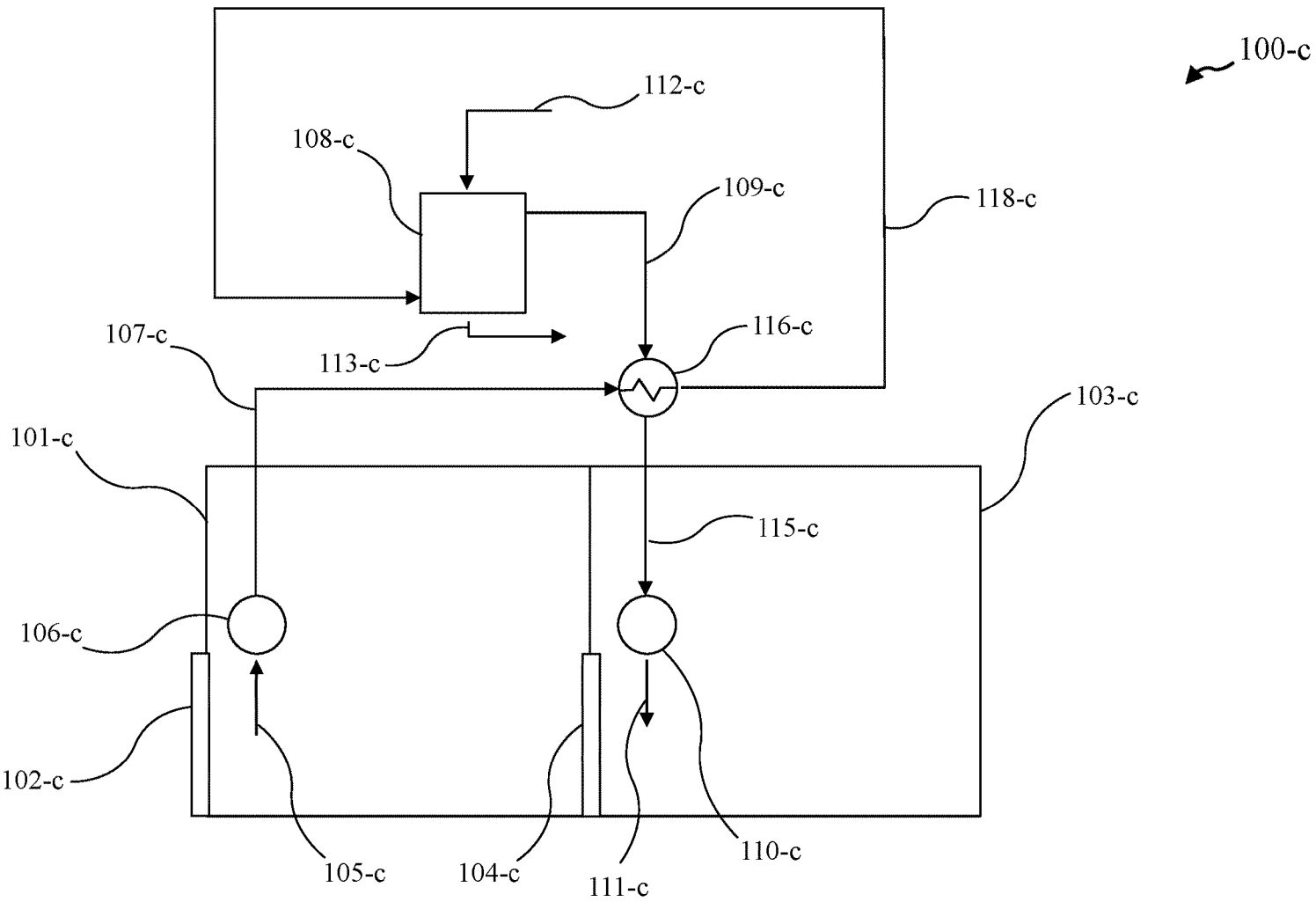
FIG. 4 shows a system in accordance with various embodiments.

FIG. 4 shows a system 100-*c* in accordance with various embodiments that may be a specific example of system 100 of FIG. 1, system 100-*a* of FIG. 2, and/or system 100-*b* of FIG. 3. System 100-*c* may utilize an air-to-air recuperator 116-*c* to return warmer air 115-*c* at a lower relative humidity to a cooler room 103-*c* (or a second volume in general). Warmer room 101-*c* (or a first volume in general) may have a door to an outside 102-*c* and a suction plenum 106-*c*, which may be near the door 102-*c*, that may provide suction of room air 105-*c*. Once in the duct, warmer air 107-*c* may be sent to the air-to-air recuperator 116-*c* where it may be cooled (i.e., the temperature of the air from the first volume may decrease through passing through the recuperator 116-*c*), which may produce a colder airflow stream 118-*c* at a higher relative humidity that may be sent to a heat and mass transfer exchanger 108-*c*, such as a wet scrubber, where cold brine 112-*c* may flow counter to it. This may produce colder, dry air 109-*c* and warmer brine 113-*c*. The cold air 109-*c* may be sent to the air-to-air recuperator 116-*c* where the air may be warmed. This may produce a warmer, but dryer, air 115-*c*. The air 115-*c* may be sent to the colder room 103-*c*, where it may enter a distribution plenum 110-*c* near a door 104-*c* between the rooms 101-*c* and 103-*c*. This may distribute cold dry air 111-*c* near the door 104-*c*, which may protect the colder temperature in room 103-*c* as the door 104-*c* may be used.

Figure 5:
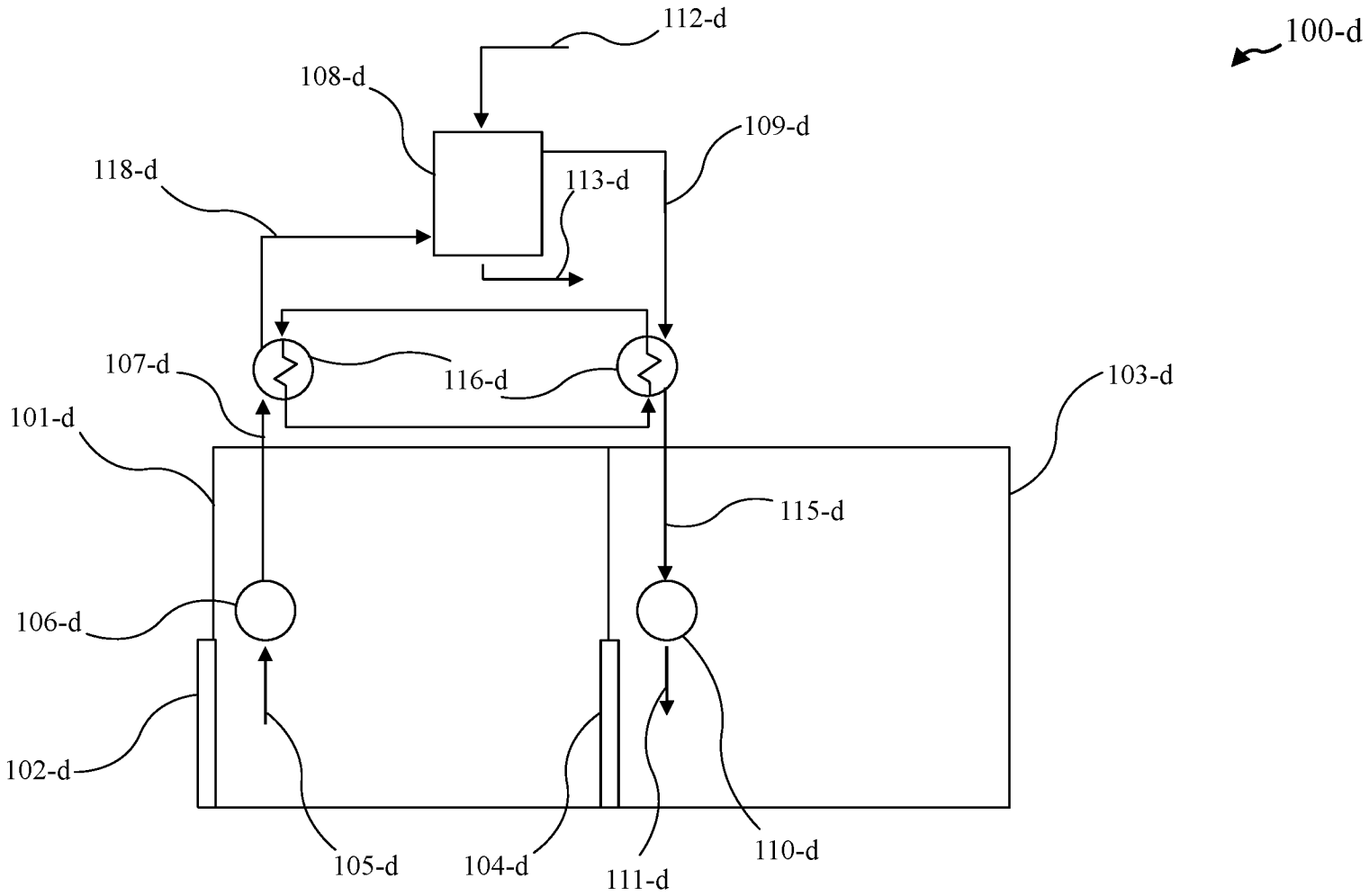
FIG. 5 shows a system in accordance with various embodiments.

FIG. 5 shows a system 100-*d* in accordance with various embodiments that may be a specific example of system 100 of FIG. 1, system 100-*a* of FIG. 2, system 100-*b* of FIG. 3, and/or system 100-*c* of FIG. 4. System 100-*d* may utilize an air-to-air indirect recuperator 116-*d* to return warmer air 115-*d* at a lower relative humidity to a cooler room 103-*d*, an example of a second volume in general. A warmer room 101-*d*, or a first volume more generally, may have a door to an outside 102-*d* and a suction plenum 106-*d*, which may be near the door 102-*d*, that may provide suction of room air 105-*d*. Once in the duct, warmer air 107-*d* may be sent to one half of the indirect recuperator 116-*d*. This recuperator 116-*d* may be two heat exchangers with an intermediary liquid, sometimes called a runaround coil or a heat pipe recuperator. The air 107-*d* passing through the first half of the recuperator 116-*d* may be cooled, decreasing a temperature of the air 107-*d*, creating a colder airflow stream 118-*d*, before it may be sent to a heat and mass transfer exchanger 108-*d*, such as a wet scrubber, where cold brine 112-*d* may flow counter to it. This may produce colder, dry air 109-*d* and warmer brine 113-*d*. The cold air 109-*d* may be sent to the other half of the indirect thermal recuperator 116-*d* where it may be warmed up (i.e., a temperature of at least a portion of the air from the first volume may increase). This may produce a warmer air 115-*d* that may be sent to the colder room 103-*d*, where it may enter a distribution plenum 110-*d*, which may be near a door 104-*d* between the rooms 101-*d* and 103-*d*. This may distribute cold, dry air 111-*d* near the door 104-*d*, which may protect the colder temperature in room or volume 103-*d* as the door 104-*d* may be used.

Figure 6:
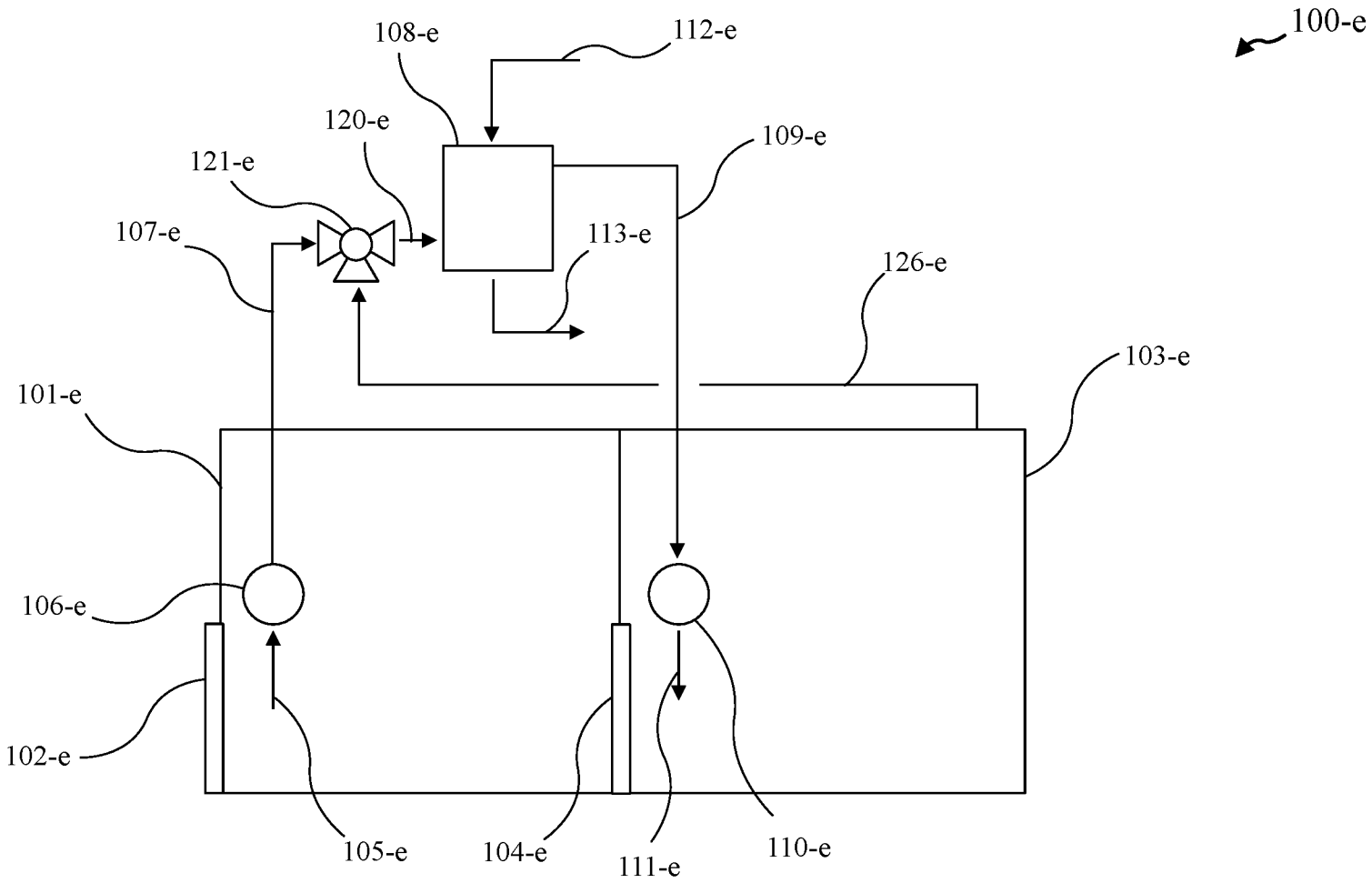
FIG. 6 shows a system in accordance with various embodiments.

FIG. 6 shows a system 100-*e* in accordance with various embodiments that may be an example of system 100 of FIG. 100 and/or system 100-*a* of FIG. 2. System 100-*e* may utilize a mixer 121-*e*, or other air combiner, to return colder air 109-*e* to a cooler room 103-*e*, or second volume more generally. A warmer room 101-*e*, or first volume more generally, may have a door to an outside 102-*e* and a suction plenum 106-*e* near door 102-*e*, which may provide suction of room air 105-*e*. Once in the duct, warmer air 107-*e* may be sent to the mixing valve or damper 121-*e*, which may mix the warmer air 107-*e* with a cold stream of air 126-*e*, which may be taken from the colder room 103-*e*. In general, the mixer 121-*e* may be configured to combine air from the first volume with air from the second volume prior to passing the air from the first volume through a heat and mass transfer exchanger 108-*e*. Mixed air 120-*e* may be sent to the heat and mass transfer exchanger 108-*e*, such as a wet scrubber, where cold brine 112-*e* may flow counter to it. This may produce colder, dry air 109-*e* and warmer brine 113-*e*. The colder, dry air 109-*e* may be sent to the colder room 103-*e*, where it may enter a distribution plenum 110-*e*, which may be positioned near a door 104-*e* between the rooms 101-*e* and 103-*e*. This may distribute cold, dry air 111-*e* near the door 104-*e*, which may protect the colder temperature in the room 103-*e* as the door 104-*e* may be used. In some embodiments of the system 100-*e*, the mixer 121-*e* is configured to prevent an airflow from the first volume 101-*e* to the heat and mass transfer exchanger 108-*e* at various times and to direct an airflow from the second volume (such as air 126-*e*) to the heat and mass transfer exchanger 108-*e* without air from the first volume 101-*e*.

Figure 7:
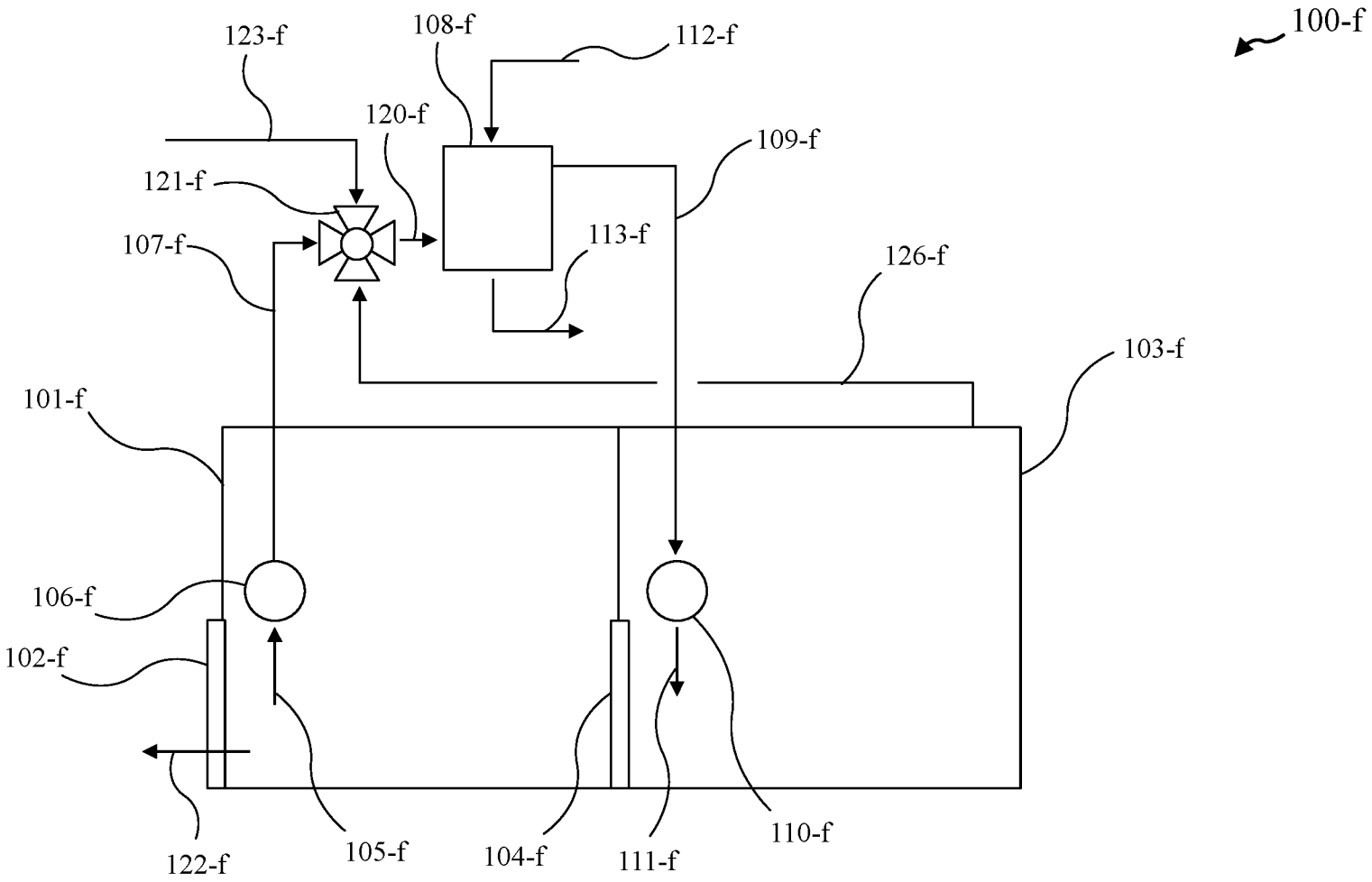
FIG. 7 shows a system in accordance with various embodiments.

FIG. 7 shows a system 100-*f* in accordance with various embodiments that may be a specific example of system 100 of FIG. 1, system 100-*a* of FIG. 2, and/or system 100-*e* of FIG. 6. System 100-*f* may utilize a mixer 121-*f* to create a higher net positive pressure inside the system 100-*f*. A warmer room 101-*f*, or a first volume in general, may have a door to an outside 102-*f* and a suction plenum 106-*f* near door 102-*f*, which may provide suction of room air 105-*f*. Once in the duct, warmer air 107-*f* may be sent to the mixing valve or damper 121-*f*, which may mix it with a cold stream of air 126-*f*, which may be taken from a colder room 103-*f*, or a second volume more generally, and ambient air 123-*f*. In general, the mixer 121-*f* may be configured to combine ambient air with at least the air from the first volume or the air from the second volume prior to passing at least the air from the first volume, the air from the second volume, or the ambient air through a heat a mass transfer exchanger 108-*f*. Mixed air 120-*f* may be sent to the heat and mass transfer exchanger 108-*f*, such as a wet scrubber, where cold brine 112-*f* may flow counter to it. This may produce colder, dry air 109-*f* and warmer brine 113-*f*. The colder, dry air 109-*f* may be sent to the colder room 103-*f*, where it may enter a distribution plenum 110-*f*, which may be positioned near a door 104-*f* between the rooms 101-*f* and 103-*f*. This may distribute cold, dry air 111-*f* near the door 104-*f*, which may protect the colder temperature in room 103-*f* as the door 104-*f* may be used. The introduction of ambient air 123-*f* in the mixing valve or damper 121-*f* may create a net positive pressure and an air flow 122-*f* out of the door 102-*f* in the warmer room 101-*f*. In some embodiments of the system 100-*f*, the mixer 121-*f* is configured to prevent an airflow from the first volume to the heat and mass transfer exchanger 108-*f* at various times and to direct an airflow from the second volume (such as air 126-*f*) to the heat and mass transfer exchanger 108-*f*, which may also include ambient air 123-*f* in some circumstances.

Figure 8:
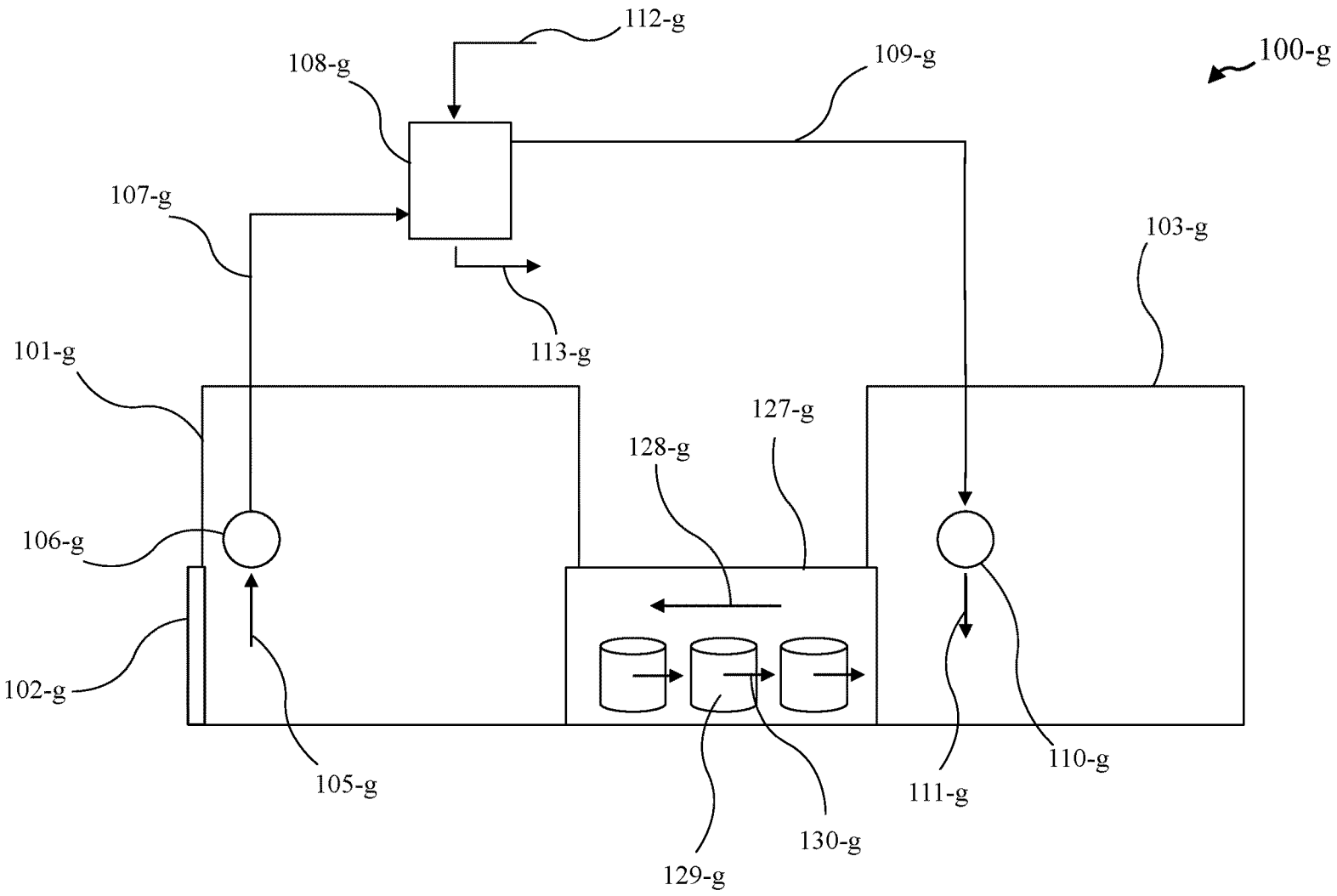
FIG. 8 shows a system in accordance with various embodiments.

FIG. 8 shows a system 100-*g* in accordance with various embodiments that may be a specific example of system 100 of FIG. 1 and/or system 100-*a* of FIG. 2. System 100-*g* may be integrated into a blast freezer 127-*g*. A warmer room 101-*g* may have a door to the outside 102-*g* and a suction plenum 106-*g*, which may be positioned near door 102-*g*, that may provide suction of room air 105-*g*. Once in the duct, warmer air 107-*g* may be sent to a heat and mass transfer exchanger 108-*g*, such as a wet scrubber, where cold brine 112-*g* may flow counter to it. This may produce colder, dry air 109-*g* and warmer brine 113-*g*. The colder dry air 109-*g* may be sent to a colder room 103-*g* where it may enter a distribution plenum 110-*g*, which may be positioned near the entrance to the linear blast freezer 127-*g*. This may distribute cold dry air 111-*g* near the entrance to blast freezer 127-*g*, which may protect the conditions in room 103-*c* as the blast freezer 127-*g* may be used. Air 128-*g* may flow through the blast freezer 127-*g* from the colder room 103-*g* to the warmer room 101-*g*. The blast freezer 127-*g* may be referred to as an interconnection positioned between the first volume 101-*g* and the second volume 103-*g*. Product 129-*g* within the blast freezer 127-*g* may move counter 130-*g* to the air flow 128-*g*, moving from the warmer room 101-*g* to the colder room 103-*g*.

Figure 9:
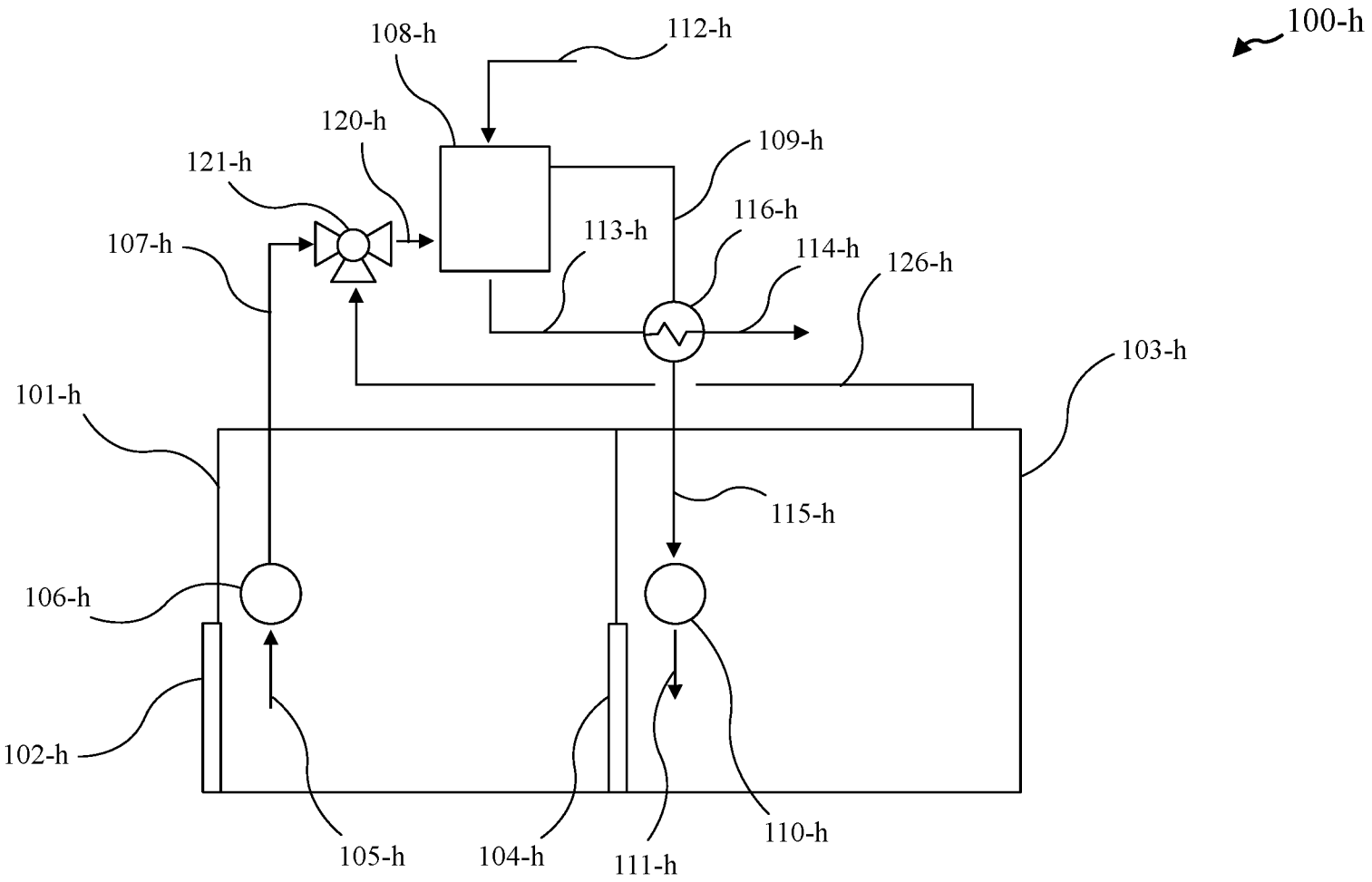
FIG. 9 shows a system in accordance with various embodiments.

FIG. 9 shows a system 100-*h* in accordance with various embodiments that may be a specific example of system 100 of FIG. 1, system 100-*a* of FIG. 2, system 100-*b* of FIG. 3, system 100-*e* of FIG. 6, and/or system 100-*g* of FIG. 8. System 100-*h* may utilize a mixer 121-*h* and a brine-to-air recuperator 116-*h* to control the temperature and humidity of the air sent to a cooler room 103-*h*. A warmer room 101-*h* may have a door to the outside 102-*h* and a suction plenum 106-*h*, which may be positioned near the door 102-*h* to provide suction of room air 105-*h*. Once in the duct, warmer air 107-*h* may be sent to a mixing valve or damper 121-*h*, which may mix it with a cold stream of air 126-*h* taken from the colder room 103-*h*. The mixer 121-*h* may be configured to combine the air from the first volume 107-*h* with air from the second volume 126-*h* prior to passing the air from the second volume (and/or the air from the second volume) through a heat and mass transfer exchanger 108-*h*. Mixed air 120-*h* may be sent to the heat and mass transfer exchanger 108-*h*, such as a wet scrubber, where cold brine 112-*h* may flow counter to it. This may produce colder dry air 109-*h* and warmer brine 113-*h*. The cold air 109-*h* may be sent to a brine-to-air recuperator 116-*h* where the air may be warmed and the brine may be cooled without any mass transfer. This may produce warmer air 115-*h* and a colder brine 114-*h* while shifting the overall ratio of sensible and latent cooling more towards latent cooling. The air 115-*h* may be sent to the colder room 103-*h* where it may enter a distribution plenum 110-*h*, which may be positioned near a door 104-*h* between the rooms 101-*h* and 103-*h*. This may distribute cold dry air 111-*h* near the door 104-*h*, which may protect the colder temperature in room 103-*h* as the door 104-*h* may be used. In some embodiments of the system 100-*h*, the mixer 121-*h* is configured to prevent an airflow from the first volume to the heat and mass transfer exchanger 108-*h* at various times and to direct an airflow from the second volume (such as air 126-*h*) to the heat and mass transfer exchanger 108-*h* without air from the first volume 101-*h*.

Figure 10:
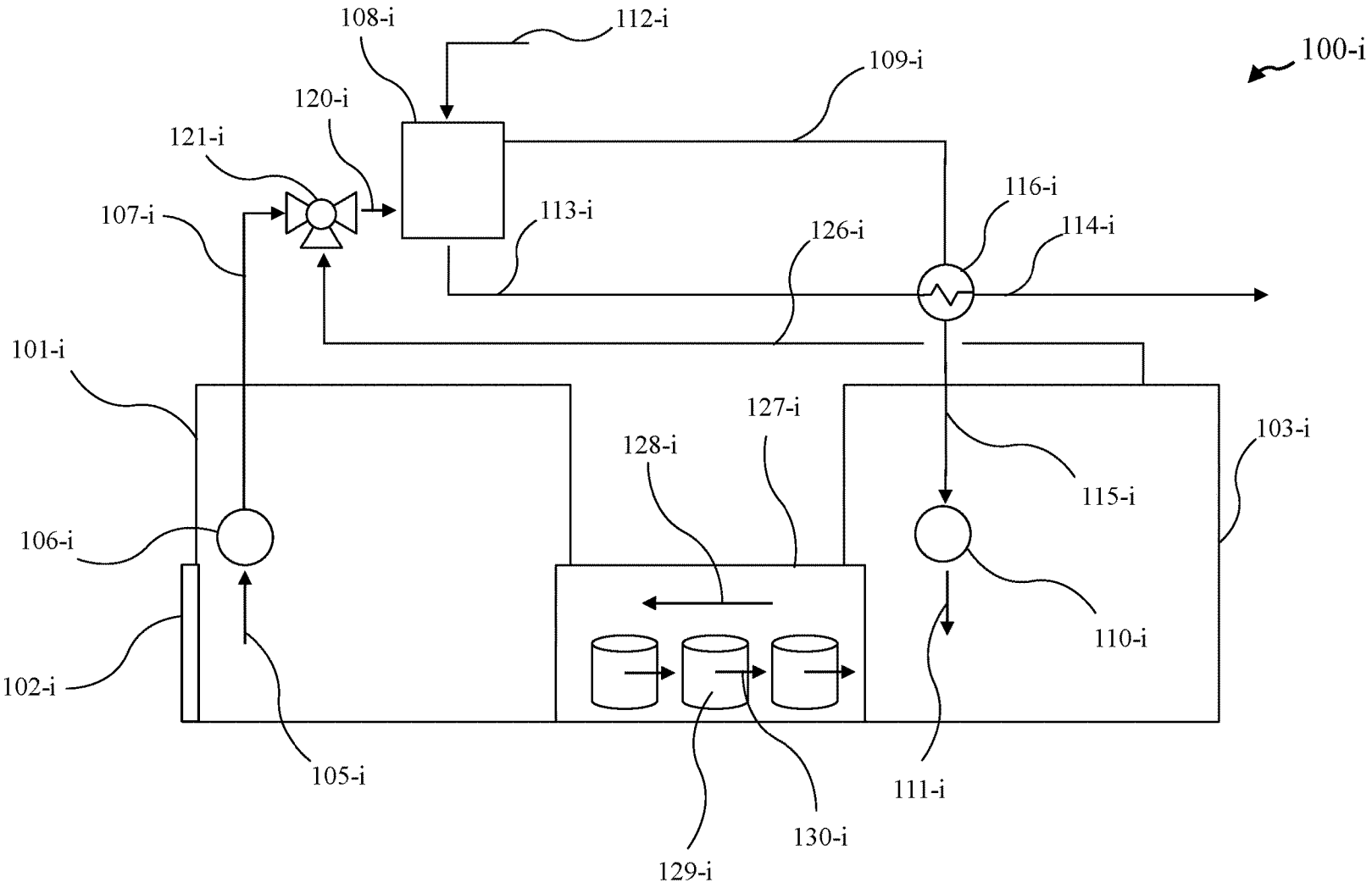
FIG. 10 shows a system in accordance with various embodiments.

FIG. 10 shows a system 100-*i* in accordance with various embodiments that may be a specific example of system 100 of FIG. 1, system 100-*a* of FIG. 2, system 100-*b* of FIG. 3, system 100-*e* of FIG. 6, system 100-*g* of FIG. 8, and/or system 100-*h* of FIG. 9. System 100-*i* may be integrated into a blast freezer 127-*i* and may utilize a mixer 121-*i* and a brine-to-air recuperator 116-*i* to return warmer air 115-*i* to a cooler room 103-*i*, or second volume more generally. A warmer room 101-*i* may have a door to the outside 102-*i* and a suction plenum 106-*i*, which may be positioned near the door 102-*i*, to provide suction of room air 105-*i*. Once in the duct, warmer air 107-*i* may be sent to a mixing valve or damper 121-*i*, which may mix it with a cold stream of air 126-*i* taken from the colder room. Mixed air 120-*i* may be sent to the wet scrubber 108-*i*, or a heat and mass transfer exchanger more generally, where cold brine 112-*i* may flow counter to it. This may produce colder dry air 109-*i* and warmer brine 113-*i*. Thus, the mixer 121-*i* may be configured to combine air from the first volume 107-*i* with air from the second volume 126-I prior to passing the air from the first volume through the heat and mass transfer exchanger 108-*i*. The colder dry air 109-*i* may be sent to a brine-to-air recuperator 116-*i* where the air may be warmed and the brine may be cooled without any mass transfer. This may produce a warmer air 115-*i* and a colder brine 114-*i*. The warmer air 115-*i* may be sent to the colder room 103-*i* where it may enter a distribution plenum 110-*i*, which may be positioned near the entrance to the linear blast freezer 127-*i*. This may distribute cold dry air 111-*i* near the blast freezer 127-*i*, which may protect the conditions in room 103-*i* as the blast freezer 127-*i* may be used. Air 128-*i* may flow through the blast freezer 127-*i* from the colder room 103-*i* to the warmer room 101-*i*. Product 129-*i* within the blast freezer 127-*i* generally moves counter 130-*i* to the air flow 128-*i*, moving from the warmer room 101-*i* to the colder room 103-*i*. In some embodiments of the system 100-*i*, the mixer 121-*i* is configured to prevent an airflow from the first volume 101-*i* to the heat and mass transfer exchanger 108-*i* at various times and to direct an airflow from the second volume (such as air 126-*i*) to the heat and mass transfer exchanger 108-*i* without air from the first volume 101-*i*.

Figure 11:
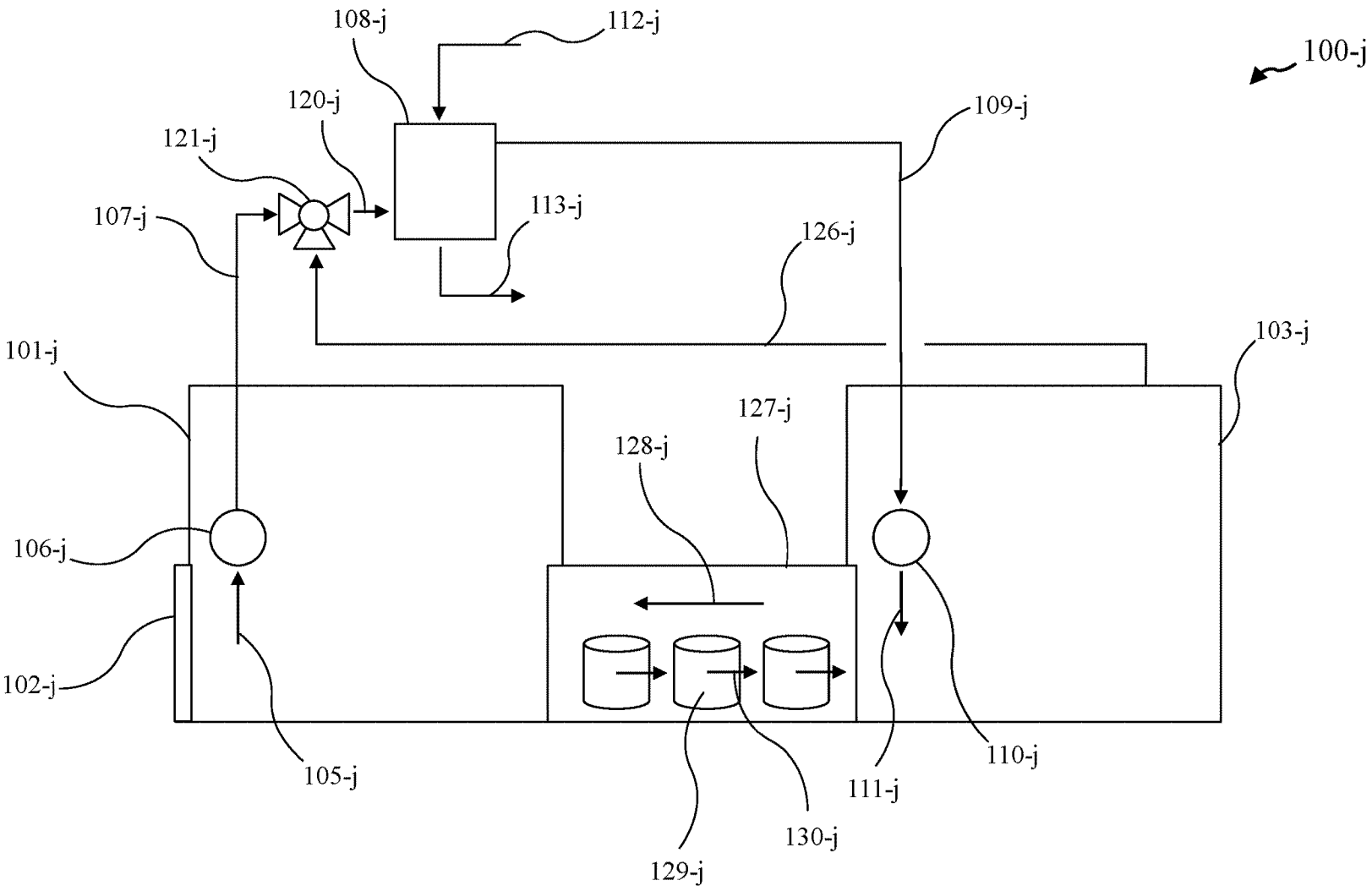
FIG. 11 shows a system in accordance with various embodiments.

FIG. 11 shows a system 100-*j* in accordance with various embodiments that may be a specific example of system 100 of FIG. 1, system 100-*a* of FIG. 2, system 100-*e* of FIG. 6, and/or system 100-*g* of FIG. 8. System 100-*j* may be integrated with a blast freezer 127-*j* and may utilize a mixer 121-*j* to return colder air 109-*j* to a cooler room 103-*j*, or second volume more generally. A warmer room 101-*j* may have a door to the outside 102-*j* and a suction plenum 106-*j*, which may be positioned near the door 102-*j* to provide suction of room air 105-*j*. Once in the duct, warmer air 107-*j* may be sent to a mixing valve or damper 121-*j*, which may mix it with a cold stream of air 126-*j* taken from the colder room 103-*j*. Mixed air 120-*j* may be sent to a wet scrubber 108-*j*, or a heat and mass transfer exchanger more generally, where cold brine 112-*j* may flow counter to it. This may produce colder dry air 109-*j* and warmer brine 113-*j*. The colder dry air 109-*j* may be sent to the colder room 103-*j* where it may enter a distribution plenum 110-*j*, which may be near the entrance to the linear blast freezer 127-*j*. This may distribute cold dry air 111-*j* near the blast freezer 127-*j*, which may protect the conditions in room 103-*j* as the blast freezer 127-*j* may be used. Air 128-*j* may flow through the blast freezer 127-*i* from the colder room 103-*j* to the warmer room 101-*j*. Product 129-*j* within the blast freezer 127-*j* generally moves counter 130-*j* to the air flow 128-*j*, moving from the warmer room 101-*j* to the colder room 103-*j*. In some embodiments of the system 100-*j*, the mixer 121-*j* is configured to prevent an airflow from the first volume 101-*j* to the heat and mass transfer exchanger 108-*j* at various times and to direct an airflow from the second volume (such as air 126-*j*) to the heat and mass transfer exchanger 108-*j* without air from the first volume 101-*j*.

Figure 12:
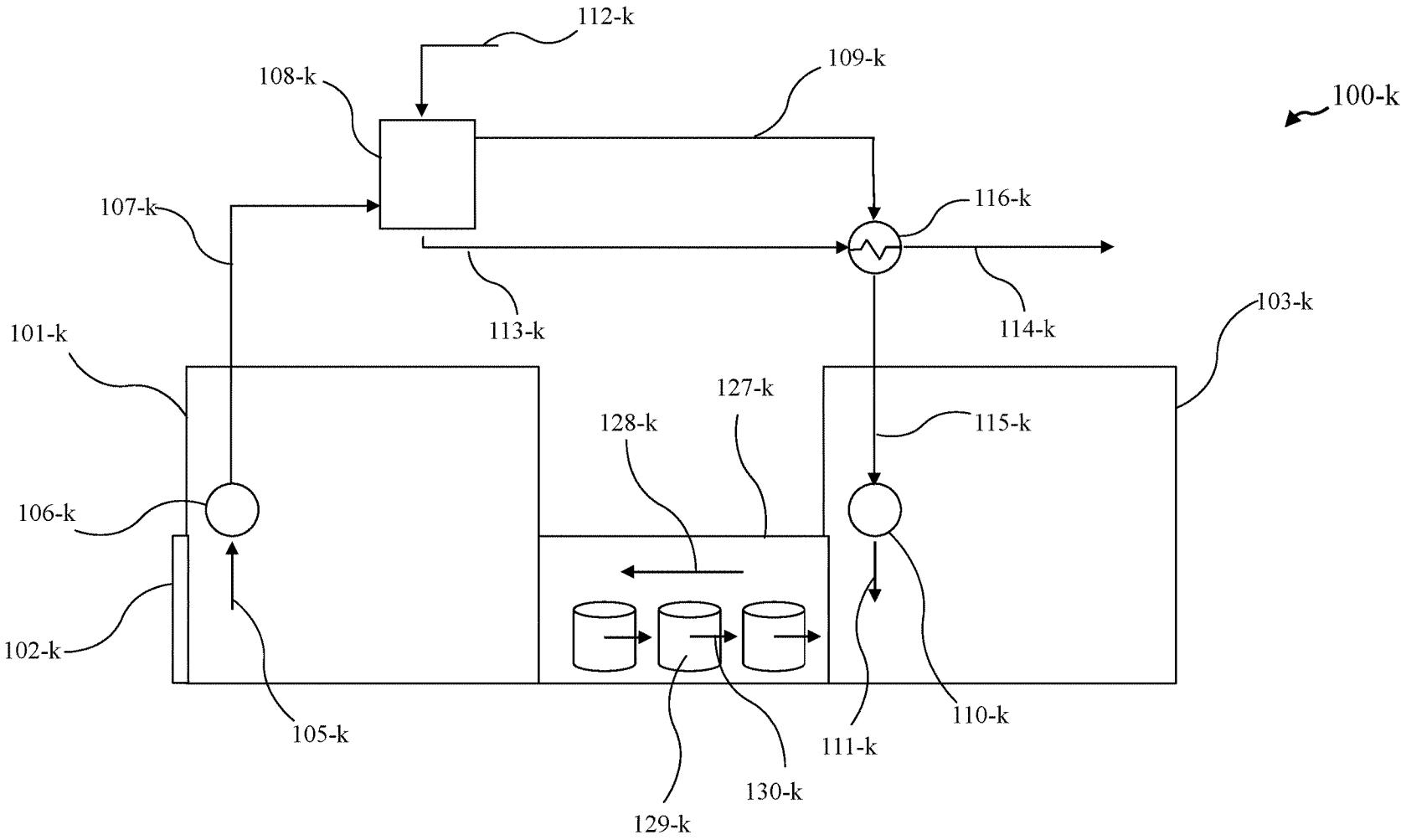
FIG. 12 shows a system in accordance with various embodiments.

FIG. 12 shows a system 100-*k* in accordance with various embodiments that may be a specific example of system 100 of FIG. 1, system 100-*a* of FIG. 2, system 100-*b* of FIG. 3, and/or system 100-*g* of FIG. 8. System 100-*k* may be integrated with a blast freezer 127-*k* and may utilize a brine-to-air recuperator 116-*k* to return warmer air 115-*k* at a lower relative humidity to a cooler room 103-*k* (or a second volume in general). Warmer room 101-*k* (or first volume in general) may have a door to an outside 102-*k* and a suction plenum 106-*k*, which may be near the door 102-*k*, to provide suction of room air 105-*k*. Once in the duct, warmer air 107-*k* may be sent to a heat and mass transfer exchanger 108-*k*, such as a wet scrubber, where cold brine 112-*k* may flow counter to it. This may produce colder, dry air 109-*k* and warmer brine 113-*k*. The colder dry air 109-*k* may be sent to a brine-to-air recuperator 116-*k* where the air may be warmed and the brine may be cooled without any mass transfer. This may produce a warmer air 115-*k* and a colder brine 114-*k*. The warmer air 115-*k* may be sent to the colder room 103-*k* where it may enter a distribution plenum 110-*k*, which may be positioned near the entrance to the linear blast freezer 127-*k*. This may distribute cold dry air 111-*k* near the blast freezer 127-*k*, which may protect the conditions in room 103-*k* as the blast freezer 127-*k* may be used. Air 128-*k* may flow through the blast freezer 127-*k* from the colder room 103-*k* to the warmer room 101-*k*. Product 129-*k* within the blast freezer 127-*k* generally moves counter 130-*k* to the air flow 128-*k*, moving from the warmer room 101-*k* to the colder room 103-*k*.

Figure 13:
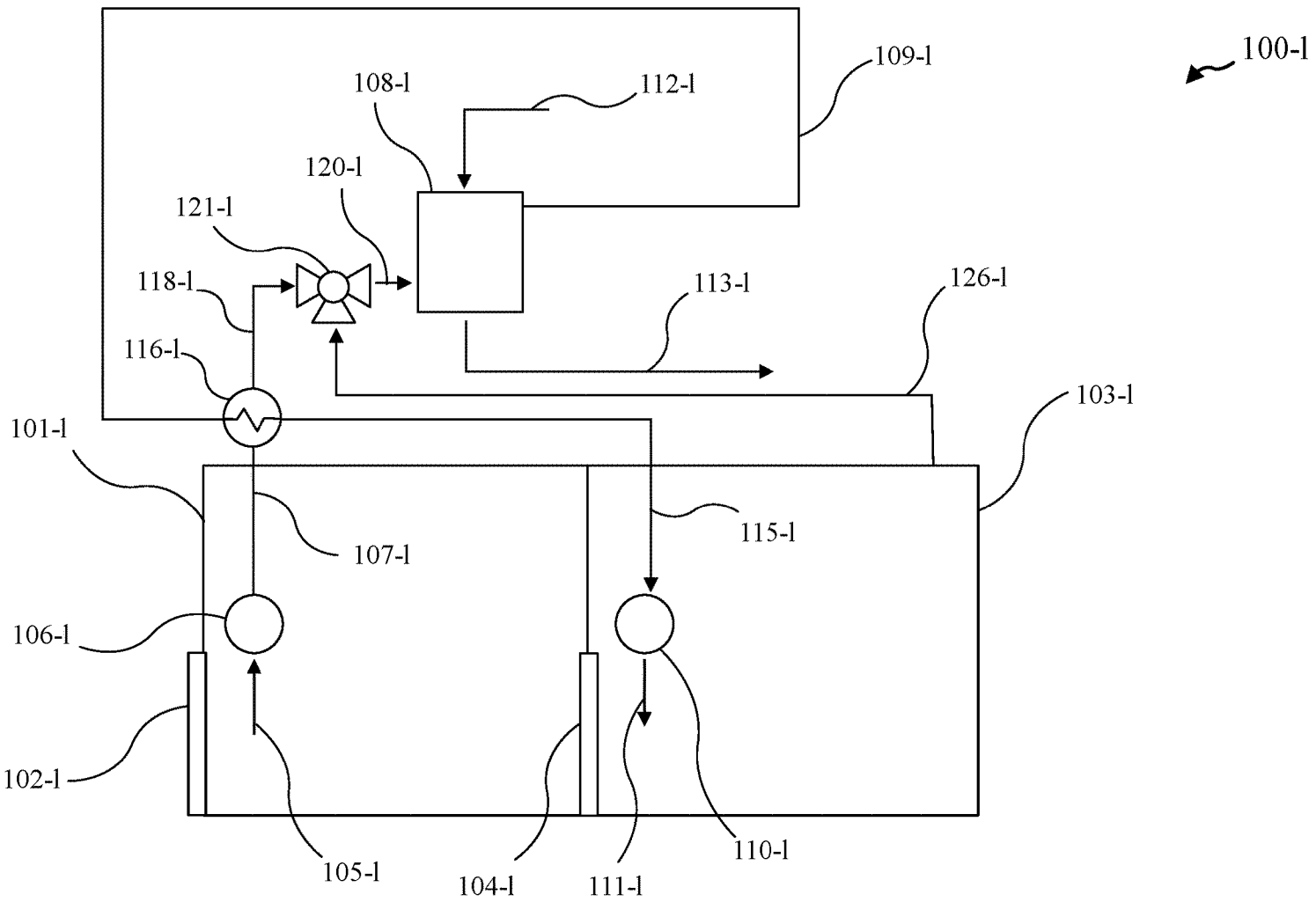
FIG. 13 shows a system in accordance with various embodiments.

FIG. 13 shows a system 100-*l* in accordance with various embodiments that may be a specific example of system 100 of FIG. 1, system 100-*a* of FIG. 2, system 100-*b* of FIG. 3, system 100-*c* of FIG. 4, system 100-*e* of FIG. 6, system 100-*f* of FIG. 7, and/or system 100-*g* of FIG. 9. System 100-*l* may utilize a mixer 121-*l* and an air-to-air recuperator 116-*l* to control a temperature and a moisture content of the air sent to a cooler room 103-*l* (or second volume in general). Warmer room 101-*l* (or first volume in general) may have a door to the outside 102-*l* and a suction plenum 106-*l*, which may be positioned near the door 102-*l* to provide suction of room air 105-*l*. Once in the duct, warmer air 107-*l* may be sent to the air-to-air recuperator 116-*l* where it may exchange heat but not mass with cold air 109-*l*. This may produce colder air 118-*l* and may produce condensate. This cold mixture may enter mixing valve or damper 121-*l*, which may mix it with a cold stream of air 126-*l* that may be taken from the colder room 103-*l*. Mixed air 120-*l* may be sent to a wet scrubber 108-*l*, or heat and mass transfer exchanger in general, where cold brine 112-*l* may flow counter to it. This may produce colder dry air 109-*l* and warmer brine 113-*l*. The cold air may be the same that was used earlier in the air-to-air heat recuperator 116-*l* to chill the incoming air 107-*l*. The colder air 109-*l* may be sent to the air-to-air recuperator 116-*l* where the air may be warmed. This may produce a warmer air 115-*l* while shifting the overall ratio of sensible and latent cooling more towards latent cooling. The air 115-*l* may be sent to the colder room 103-*l* where it may enter a distribution plenum 110-*l*, which may be positioned near a door 104-*l* between the rooms 101-*l* and 103-*l*. This may distribute cold dry air 111-*l* near the door 104-*l*, which may protect the colder temperature in that room as the door 104-*l* may be used. In some embodiments of the system 100-*l*, the mixer 121-*l* is configured to prevent an airflow from the first volume 101-*l* to the heat and mass transfer exchanger 108-*l* at various times and to direct an airflow from the second volume (such as air 126-*l*) to the heat and mass transfer exchanger 108-*l* without air from the first volume 101-*l*.

While the above embodiments generally discuss the use of a first volume and a second volume, one skilled in the art would recognize that additional volumes may be integrated into the noted systems either in series and/or in parallel with the other volumes. In reality, very few facilities may have so few rooms or volumes and such simple cooling needs. Instead, facilities may have 10 or more rooms, each with their own needs for relative humidity and temperature, for example. Through the combination of the above embodiments, however, it can be seen how the embodiments can be used to accomplish the management of multiple rooms (or volumes in general), with multiple temperature, pressure, and/or relative humidity parameters. In general, air from a first volume (sometimes mixed with air from a second volume and/or ambient air) may pass through a heat and mass transfer exchanger; at least a portion of the air from the first volume may then be sent to the second volume (in some cases, at least the portion of the air from the first volume may also pass through a recuperator); in some instances, at least the portion of the air from the first volume may include substantially all of the air from the first volume that may have passed through the heat and mass transfer exchanger. In systems with multiple additional volumes, at least another portion of the air from the first volume may be sent to one or more of the additional volumes after the air from the first volume passes through the heat and mass transfer exchanger (in some cases, at least the other portion of the air from the first volume may also pass through a recuperator). Furthermore, many facilities may have processes besides room storage that can be served by the various embodiments. These processes may include blast freezing, product freezing, IQF freezing, spiral freezing, blast cooling, product cooling, spiral cooling, or any other process that may require the removal of heat over a temperature range from a product.

Also, with respect to the references numbers that refer generally to air from a first volume, air from a second volume, ambient air, or combinations thereof, these references numbers may also refer to ducts or other structures that provide for air to move between various regions or components of the systems. This may include, but is not limited to, reference numbers 107, 109, 115, 118, 120, 123, and/or 126. Similarly, the references numbers that generally refer to brine may refer to pipes or other structures that provide for brine to flow between various regions or components of the systems. This may include, but is not limited to, reference numbers 112, 113, and/or 114.

Furthermore, the use of heat and mass transfer exchangers may include a wide variety of components. Several embodiments include wet scrubbers as specific examples, which may include a wide variety of components, including, but not limited to, vertical flow over a packed bed, horizontal flow over a packed bed, spray into the flow, spray against the flow, flow through trays, and/or entraining flow through a venturi or ejector. Other heat and mass transfer exchangers may be utilized, including, but not limited to, membrane-based exchangers that may include hydrophobic, porous membranes or hydrophilic, non-porous membranes.

Figure 14:
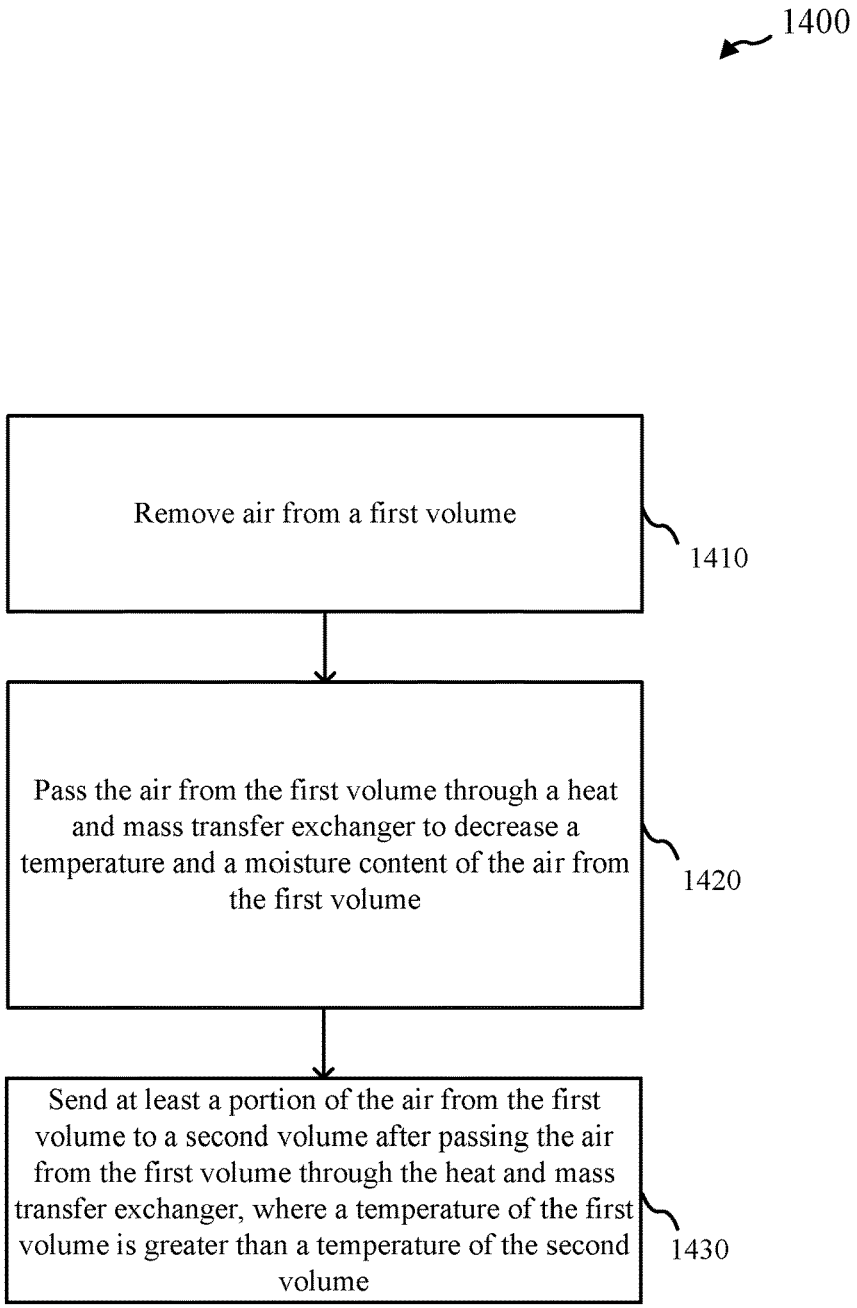
FIG. 14 shows a flow diagram of a method in accordance with various embodiments.

Turning now to FIG. 14, a flow diagram of a method 1400 is shown in accordance with various embodiments. Method 1400 may be implemented utilizing a variety of systems and/or devices such as those shown and/or described with respect to FIG. 1, FIG. 2, FIG. 3, FIG. 4, FIG. 5, FIG. 6, FIG. 7, FIG. 8, FIG. 9, FIG. 10, FIG. 11, FIG. 12, and/or FIG. 13.

At block 1410, air from a first volume may be removed. At block 1420, the air from the first volume may be passed through a heat and mass transfer exchanger to decrease a temperature and a moisture content of the air from the first volume. At block 1430, at least a portion of the air from the first volume may be sent to a second volume after passing the air from the first volume through the heat and mass transfer exchanger; a temperature of the first volume is greater than a temperature of the second volume.

Some embodiments of the method 1400 include flowing air from the second volume to the first volume. In some embodiments, passing the air from the first volume through the heat and mass transfer exchanger to decrease the temperature and the moisture content of the air from the first volume includes passing the air from the first volume through a wet scrubber. In some embodiments, passing the air from the first volume through the wet scrubber includes flowing a brine counter to a flow of the air from the first volume; a temperature of the brine may be lower than a temperature of the air from the first volume. Some embodiments include passing at least a portion of the brine from the web scrubber and at least the portion of the air from the first volume through a recuperator to decrease the temperature of the brine and to increase a temperature of at least the portion of the air from the first volume.

Some embodiments of the method 1400 include distributing at least the portion of the air from the first volume sent to the second volume utilizing a distribution plenum positioned within the second volume. Some embodiments of the method include introducing ambient air into the first volume.

Some embodiments of method 1400 include passing at least the portion of the air from the first volume through a recuperator. In some embodiments, passing at least the portion of the air from the first volume through the recuperator occurs after the air from the first volume passes through the heat and mass transfer exchanger such that the temperature of at least the portion of the air from the first volume increases through passing through the recuperator. Some embodiments include passing the air from the first volume through the recuperator before the air from the first volume passes through the heat and mass transfer exchanger such that the temperature of the air from the first volume decreases through passing through the recuperator. In some embodiments, passing at least the portion of the air from the first volume through the recuperator increases the temperature of at least the portion of the air from the first volume after the air from the first volume passes through the heat and mass transfer exchanger. Some embodiments include combining the air from the first volume with air from the second volume prior to passing the air from the first volume through the heat and mass transfer exchanger.

Some embodiments of the method 1400 include combining the air from the first volume with air from the second volume prior to passing the air from the first volume through the heat and mass transfer exchanger. Some embodiments include combining ambient air with at least the air from the first volume or the air from the second volume prior to passing at least the air from the first volume, the air from the second volume, or the ambient air through the heat and mass transfer exchanger.

In some embodiments of the method 1400, flowing the air from the second volume to the first volume includes flowing the air from the second volume to the first volume through a blast freezer positioned between the first volume and the second volume. Some embodiments include moving a product through the blast freezer counter to the air from the second volume flowing to the first volume through the blast freezer.

Some embodiments of the method 1400 include combining the air from the first volume with air from the second volume prior to passing the air from the first volume through the heat and mass transfer exchanger. Some embodiments include positioning a blast freezer between the first volume and the second volume.

Some embodiments of the method 1400 include: removing air from the second volume; passing the air from the second volume through the heat and mass transfer exchanger to decrease a temperature and a moisture content of the air from the second volume; and sending at least a portion of the air from the second volume to the second volume after passing the air from the first volume through the heat and mass transfer exchanger. Some embodiments include at least passing the air from the second volume through a recuperator before passing the air from the second volume through the heat and mass transfer exchanger or passing at least the portion of the air from the second volume through the recuperator after the air from the second volume passes through the heat and mass transfer exchanger.

These embodiments may not capture the full extent of combinations and permutations of materials and process equipment. However, they may demonstrate the range of applicability of the methods, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figures.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A method comprising:

removing air from a first room in a facility;

passing the air from the first room in the facility through a heat and mass transfer exchanger to decrease a temperature and a moisture content of the air from the first room in the facility, wherein passing the air from the first room in the facility through the heat and mass transfer exchanger to decrease the temperature and the moisture content of the air from the first room in the facility includes passing the air from the first room in the facility through a wet scrubber; and sending at least a portion of the air from the first room in the facility to a second room in the facility after passing the air from the first room in the facility through the heat and mass transfer exchanger, wherein a temperature of the first room in the facility is greater than a temperature of the second room in the facility; and flowing air from the second room in the facility to the first room in the facility.

2. The method of claim 1, wherein passing the air from the first room in the facility through the wet scrubber includes flowing a brine counter to a flow of the air from the first room in the facility wherein a temperature of the brine is lower than a temperature of the air from the first room in the facility.

3. The method of claim 1, further comprising distributing at least the portion of the air from the first room in the facility sent to the second room in the facility utilizing a distribution plenum positioned within the second room in the facility.

4. The method of claim 1, further comprising introducing ambient air into the first room in the facility.

5. The method of claim 1, further comprising passing at least the portion of the air from the first room in the facility through a recuperator.

6. The method of claim 5, further comprising passing the air from the first room in the facility through the recuperator before the air from the first room in the facility passes through the heat and mass transfer exchanger such that the temperature of the air from the first room in the facility decreases through passing through the recuperator.

7. The method of claim 6, wherein passing at least the portion of the air from the first room in the facility through the recuperator increases the temperature of at least the portion of the air from the first volume after the air from the first room in the facility passes through the heat and mass transfer exchanger.

8. The method of claim 7, further comprising combining the air from the first room in the facility with air from the second room in the facility prior to passing the air from the first room in the facility through the heat and mass transfer exchanger.

9. The method of claim 5, wherein passing at least the portion of the air from the first room in the facility through the recuperator occurs after the air from the first room in the facility passes through the heat and mass transfer exchanger such that the temperature of at least the portion of the air from the first room in the facility increases through passing through the recuperator.

10. The method of claim 9, further comprising combining the air from the first room in the facility with air from the second room in the facility prior to passing the air from the first room in the facility through the heat and mass transfer exchanger.

11. The method of claim 10, further comprising positioning a blast freezer between the first room in the facility and the second room in the facility.

12. The method of claim 1, further comprising combining the air from the first room in the facility with air from the second room in the facility prior to passing the air from the first room in the facility through the heat and mass transfer exchanger.

13. The method of claim 12, further comprising combining ambient air with at least the air from the first room in the facility or the air from the second room in the facility prior to passing at least the air from the first room in the facility, the air from the second room in the facility, or the ambient air through the heat and mass transfer exchanger.

14. The method of claim 1, further comprising:

removing air from the second room in the facility;

passing the air from the second room in the facility through the heat and mass transfer exchanger to decrease a temperature and a moisture content of the air from the second room in the facility; and sending at least a portion of the air from the second room in the facility to the second room in the facility after passing the air from the first volume through the heat and mass transfer exchanger.

15. The method of claim 14, further comprising at least passing the air from the second room in the facility through a recuperator before passing the air from the second room in the facility through the heat and mass transfer exchanger or passing at least the portion of the air from the second room in the facility through the recuperator after the air from the second room in the facility passes through the heat and mass transfer exchanger.

16. A method comprising:

removing air from a first volume;

passing the air from the first volume through a heat and mass transfer exchanger to decrease a temperature and a moisture content of the air from the first volume, wherein passing the air from the first volume through the heat and mass transfer exchanger to decrease the temperature and the moisture content of the air from the first volume includes passing the air from the first volume through a wet scrubber and wherein passing the air from the first volume through the wet scrubber includes flowing a brine counter to a flow of the air from the first volume and wherein a temperature of the brine is lower than a temperature of the air from the first volume;

passing at least a portion of the brine from the wet scrubber and at least the portion of the air from the first volume through a recuperator to decrease the temperature of the brine and to increase a temperature of at least the portion of the air from the first volume;

sending at least a portion of the air from the first volume to a second volume after passing the air from the first volume through the heat and mass transfer exchanger, wherein a temperature of the first volume is greater than a temperature of the second volume.

17. A method comprising:

removing air from a first volume;

passing the air from the first volume through a heat and mass transfer exchanger to decrease a temperature and a moisture content of the air from the first volume;

sending at least a portion of the air from the first volume to a second volume after passing the air from the first volume through the heat and mass transfer exchanger, wherein a temperature of the first volume is greater than a temperature of the second volume; and flowing air from the second volume to the first volume, wherein flowing the air from the second volume to the first volume includes flowing the air from the second volume to the first volume through a blast freezer positioned between the first volume and the second volume.

18. The method of claim 17, further comprising moving a product through the blast freezer counter to the air from the second volume flowing to the first volume through the blast freezer.

* * * * *